United States Patent [19]

Bassinger

[11] 3,964,551

[45] June 22, 1976

[54] PNEUMATIC IMPACT DRILLING TOOL

[75] Inventor: Grey Bassinger, San Antonio, Tex.

[73] Assignee: Reed Tool Company, Houston, Tex.

[22] Filed: Sept. 20, 1974

[21] Appl. No.: 507,968

[52] U.S. Cl. ..... 173/73; 173/78; 173/80; 173/136

[51] Int. Cl.[2] ..... E21B 21/00

[58] Field of Search ..... 173/73, 78, 80, 136

[56] References Cited

UNITED STATES PATENTS

| | | | |
|---|---|---|---|
| 2,887,989 | 5/1959 | Dulaney | 173/78 |
| 3,311,177 | 3/1967 | Collier et al. | 173/80 |
| 3,503,459 | 3/1970 | Schindler | 173/80 |
| 3,527,239 | 9/1970 | Boom | 175/92 |
| 3,606,930 | 9/1971 | Curington | 173/73 |
| 3,616,868 | 11/1971 | Bassinger | 173/73 |
| 3,826,316 | 7/1974 | Bassinger | 173/73 |

*Primary Examiner*—James A. Leppink
*Attorney, Agent, or Firm*—Cox, Smith, Smith, Hale & Guenther Incorporated

[57] ABSTRACT

A pneumatically operated impact drilling tool for rotary drilling, includes a reciprocating hammer, an anvil positioned under the hammer and a feeder means extending through the hammer. The drilling tool is connected in a string of drilling pipe and high pressure pneumatic fluid flowing through the drilling pipe operates the impact tool. The feeder directs and times the flow of fluid through ports in the hammer to create a first pressure zone to raise the hammer off the anvil, and a second pressure zone above the hammer to drive the hammer down against the anvil to create an impact on the drill bit. Exhaust ports in the hammer exhaust the fluid from the second pressure zone.

14 Claims, 12 Drawing Figures

PNEUMATIC IMPACT DRILLING TOOL

BACKGROUND OF THE INVENTION

This invention relates to an impact drilling tool and, more particularly, to a pneumatically actuated impact drilling tool for rotary drilling utilizing a hammer which strikes an anvil to create an impact force on the drill bit.

Prior to the present invention there have been many types of pneumatically operated impact drilling tools. U.S. Pat. No. 3,616,868 represents a prior version of a fluid actuated impact tool by the present inventor. Another example of a pneumatically operated impact tool can be found in U.S. Pat. No. 3,826,316 issued to Ross Bassinger. Within the prior art there are many types of pneumatically operated devices to create an impact on the drill bit. The drill bit is normally attached to an anvil that is hit by a reciprocating hammer.

To provide a reciprocating hammer that is pneumatically operated within a rotary type impact drilling tool, several valving functions must be performed. For situations involving loss of pressure, a check valve must be incorporated within the impact drilling tool to prevent a reverse flow of fluid (air) within the impact drilling tool thereby drawing cuttings within the moving parts of the tool. A valve mechanism must also provide a means for pressurized air to exert force on the bottom of the hammer thereby raising the hammer above the anvil. Other valving functions must provide a means for exhausting the pressurized air which raises the hammer and to provide pressurized air for driving the hammer against the anvil. The pressurized air above the hammer must be exhausted before the repeating of the next cycle.

In pneumatically operated percussion type rotary drilling tools, the drill rate of a standard drill bit using standard pressure becomes the key to the success of the percussion tool. However, increased drilling rate cannot be accomplished at the expense of destroying the drilling equipment, namely the drill bit. It has been found in the past that a standard holddown force can be applied to rotary drill bits with an impact force being superimposed thereon to greatly increase the rate of drilling. It has also been found in the past that if the impact force can be increased and the holddown force decreased the drill rate can be increased without damage to the drilling equipment. Since the pressure of the pneumatic fluid is normally fixed at a given level, the downward impact of the hammer is dependent upon the upper surface area the fluid is acting against, the stroke length of the hammer and the time required for pressurization and exhaust.

A typical example of a pneumatically operated impact drilling tool that is being commonly sold today is U.S. Pat. No. 3,503,459. This particular patent has numerous limitations including weak structural walls of the casing, very expensive to manufacture, much smaller downward force due to a small surface area which the downward pressure acts against and slow pressurization and exhaust. Any undercut or passage through the casing of an impact drilling tool seriously weakens the lateral strength of the tool, especially for small diameter tools. The patent mentioned in this paragraph is especially weak in the outer casing which may result in bending and subsequent failure.

Various types of percussion drilling devices have been designed and patented where the entire upper diameter of the hammer element is acted upon by the pressurized fluid to drive the hammer downward against the anvil. However, to perform the necessary valving functions each of these devices requires undercuts in the casing with cross bores, slots, undercuts and/or vertical feeds being necessary within the hammer element itself. To insure against structural damage of the hammer element each of these bores, cross slots, undercuts, etc., must end in a rounded surface to prevent structural fatigue and subsequent breaking of the hammer. All of these problems result in decreased strength of the hammer, increased expense of manufacturing and decreased lateral strength of the impact drilling tool.

SUMMARY OF THE INVENTION

The present invention provides a pneumatically actuated impact tool for rotary drilling. A hammer element reciprocates along the axis of the drilling tool to repeatedly strike an anvil to which a bit is attached. The hammer is repeatedly raised and driven downward by the pneumatic fluid that is normally supplied through the drilling pipe to the drill bit. All valving functions are controlled from the center of the hammer element thereby allowing a maximum surface area against which the pressurized pneumatic fluid will act to drive the hammer downward against the anvil. No undercuts or feeds extend through the casing. The pressurization and exhaust time are minimum. A minimum amount of expense for manufacturing the impact drilling tool is involved.

It is an object of the present invention to provide a pneumatically actuated impact tool for rotary drilling at a minimum expense of production.

It is another object of this invention to provide a pneumatically actuated impact tool for rotary drilling that has increased lateral strength and increased downward force for a given pressure pneumatic fluid.

It is yet another object of the present invention to provide a novel means for performing the valving functions of a pneumatically actuated impact drilling tool, most of said valving functions being controlled by a center feeder that extends along the axis of a hammer element.

It is even another object of the present invention to provide a center feeder for pneumatically actuated impact drilling tool that may be tuned according to the various drilling parameters including rate of impact and pressure of pneumatic fluid available.

It is another object of the present invention to provide a hammer element for a pneumatically actuated impact drilling tool that has a maximum strength, maximum upper surface area and maximum mass to give the largest possible force per blow against the anvil.

It is yet a further object of the present invention to provide hammer and feeder elements for a pneumatically actuated impact drilling tool that has mating annular spaces to insure rapid pressurization and exhaust to increase the repetition and force of each blow delivered by the hammer element.

It is yet another object of the present invention to provide a tuneable bypass means for a pneumatically actuated impact drilling tool wherein the bypass means provides a constant blowing to the drill bit and may be utilized to tune the operation of the impact drilling tool.

It is yet another object of the present invention to provide a novel check valve means formed from a ball that collapses when subjected to pressurized air and prevents a reverse flow upon loss of the pressurized air.

In the present invention pneumatic fluid (normally air with an oil mixture) is flowing through a string of drilling pipe. Immediately above the drill bit the present invention is incorporated within the string of drilling pipe. The pressurized air that is received into the impact drilling tool collapses a ball type check valve and feeds through a center feeder element below a hammer element. The pressurized air lifts the hammer and immediately thereafter begins pressurizing above the hammer element and exhausting below the hammer element. The hammer element is driven down against an anvil by the pressurized air. Simultaneously, pressurized air above the hammer element is exhausted through the feeder element to the drill bit and pressurization below the hammer element begins again.

This cycle is continually repeated with the hammer element delivering blows to the anvil to which a drill bit is attached. A restrictive orifice in the feeder element allows a continual blowing to the drill bit and provides a means for tuning the hammer element. The entire center feeder may be replaced to meet varying parameters commonly encountered in rotary type drilling operations.

DESCRIPTION OF THE PREFERRED EMBODIMENT

Figure 1A:
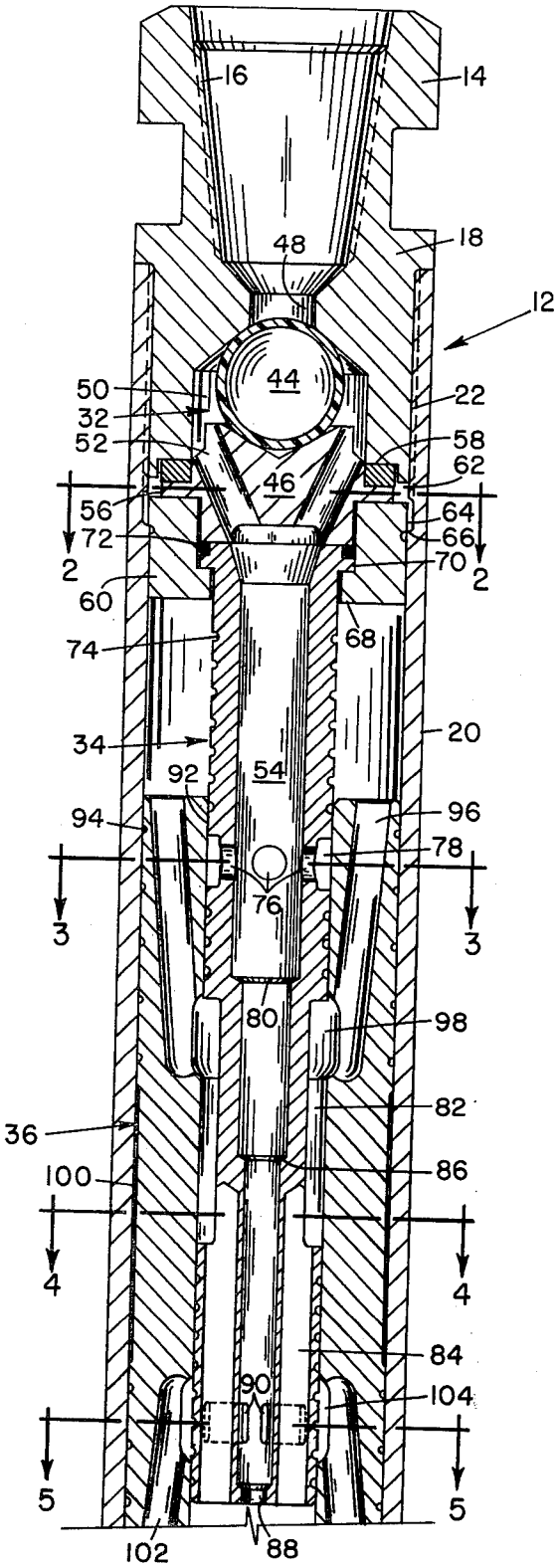
FIG. 1*a* and FIG. 1*b* are elevated sectional views taken along the longitudinal axis of the present invention.
Figure 1B:
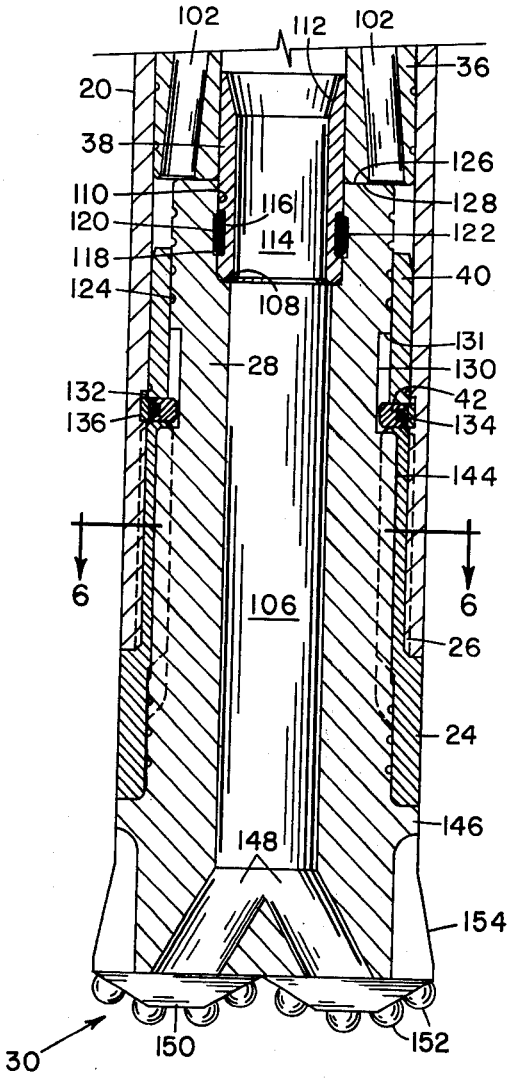

Referring now to FIGS. 1*a* and 1*b* in combination there is shown an elongated cross sectional view of the present invention wherein reference numeral 12 represents the pneumatic impact drilling tool. The present invention is designed for connection in a string of drilling pipe immediately above a drill bit. The pneumatic impact drilling tool 12 has an upper sub 14 that is connected by means of threads 16 to the drilling pipe (not shown). To the lower portion 18 of the upper sub 14 is connected a casing 20 by means of threads 22. The internal portion of the casing 20 which incorporates the present invention will be described in more detail subsequently. The bottom of the casing 20 connects to a lower sub 24 by means of threads 26. Inside of lower sub 24 is retained an anvil 28 which is formed integral with drill bit 30.

Enclosed within the casing 20 is located a check valve 32 which allows pneumatic fluid to flow from the string of drilling pipe, through the pneumatic impact drilling tool 12 to the drill bit 30, but not vice-versa. This prevents cuttings from the drill bit 30 from being sucked into the pneumatic impact drilling tool 12. Immediately below the check valve 32 is located a feeder element 34 which controls many of the valving functions of the pneumatic impact drilling tool 12. Around the feeder element 34 is located an axially slideable hammer element 36 that repeatedly hits the top of anvil 28. Between the hammer 36 and the anvil 28 is located an exhauster 38 which controls at least one of the exhaust functions of the pneumatic impact drilling tool 12. For assembly purposes an anvil guide ring 40 and retainer split ring 42 retain the anvil 28 in casing 20.

Figure 2:
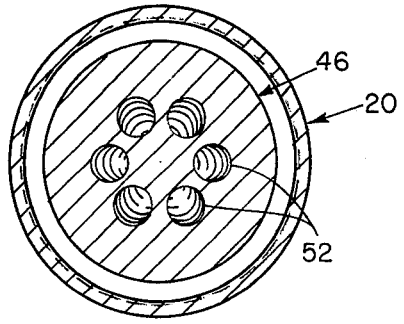
FIG. 2 is a sectional view of FIG. 1*a* taken along section lines 2—2.

Before describing a method of operation of the present invention a very detailed description of the structure will be given in the following paragraphs. The check valve 32 comprises a collapsible ball 44 located between the valve seat 46 and large orifice 48 formed by the lower portion 18 of upper sub 14. The collapsible ball 44 which is located in opening 50 has a hollow center and will collapse when subjected to a high pressure fluid. Though there are many ways of manufacturing the collapsible ball 44, in the present invention it is being spun out of a urethane with a reinforcing fiber to insure maximum life expectancy under very rugged working conditions. The valve seat 46 has a series of slanting passages 52 that will allow air flow from opening 50 to center bore 54 of feeder 34. The configuration of the valve seat 46 can best be understood when considered in conjunction with the cross sectional view of FIG. 2.

The valve seat 46 is maintained in position by means of flange 56 that is wedged between makeup ring 58 and feeder retainer 60. The makeup ring 58 is formed from an oil resistant elastomer to provide a degree of flexibility in the positioning of the valve seat 46. Around the outer edge of flange 56 is located an annular space which, in conjunction with the loose fit between feeder retainer 60 and valve seat 46, will allow a degree of lateral adjustment. The feeder retainer 60 has a slight shoulder 64 for mating against casing shoulder 66 thereby holding feeder retainer 60 into position when upper sub 14 is tightened to casing 20 by means of threads 22. The lower portion of the feeder retainer 60 has an inward flange 68 that mates against outward flange 70 of feeder 34. Outward flange 70 is somewhat smaller than the inside of feeder retainer 60 to allow a degree of lateral flexibility. However, O-ring seat 72 is located at the top of outward flange 70 to insure against leakage of the pneumatic fluid around the feeder 34. By using the elastomer makeup ring 58 and the O-ring seal 74 no substantial pressure should be developed below feeder retainer 60 without passing through center bore 54.

The feeder 34, as well as the hammer element 36 and anvil 28, have a series of oil grooves with oil groove 74 being a typical example to prevent wear between sliding surfaces and to insure an oil mixture in the air will provide the lubrication necessary for proper operation and a good seal.

Figure 3:
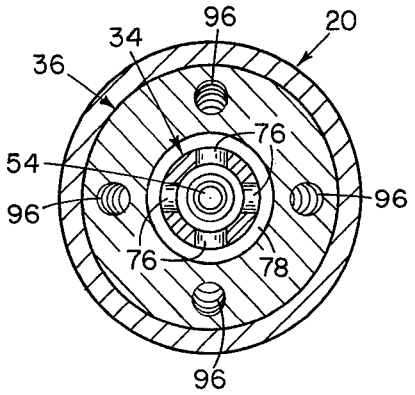
FIG. 3 is a sectional view of FIG. 1*a* taken along section lines 3—3.

The first opening from the uppermost portion of center bore 54 is cross bores 76 that connect to annulus 78. A better understanding of the construction of the feeder 34 with the cross bores 76 and annulus 78 can be obtained by referring to the cross sectional view shown in FIG. 3.

The diameter of the center bore 54 of feeder 34 decreases at the mid section thereof by means of inward shoulder 80. Also at the mid section of the feeder 34 is cut an elongated annulus 82 the function of which will be described in more detail subsequently. The bottom of the elongated annulus 82 cuts the outer portion of axial bores 84 the arrangement of which can be seen in more detail in the cross sectional view of FIG. 4. The axial bores 84 which extend parallel to the elongated axis of the feeder 34 establish continual fluid communication between elongated annulus 82 and the bottom of feeder 34. Also, the center bore 54 is further reduced by a second inward shoulder 86 so that the lower portion thereof is approximately the same diameter as the axial bores 84. At the bottom of the center bore 54 is located a restrictive orifice 88 that will allow a small amount of pneumatic fluid to continually flow through the feeder 34. The restrictive orifice 88 cannot accommodate the high volume of pneumatic fluid (air) that is necessary in rotary drilling operations, and is used mainly to insure that the full capacity of a compressor (not shown) that supplies the air may be utilized. Immediately above the restrictive orifice 88 is located a series of cross slots 90 that extend from the center bore 54 in a radially outward direction. The configuration and construction of the feeder 34 can best be understood when referring to FIG. 5 and FIG. 1a in combination. It is very important that none of the cross slots 90 interact any of the axial bores 34 as is clearly seen in FIG. 5.

It should be understood that the feeder 34 is located along the elongated axis of the pneumatic impact drilling tool 12 with the outside diameter of the upper portion (excluding the flange 70) being substantially the same as the outside diameter of the lower portion. The feeder 34 may be made from any suitable substance, but in the preferred embodiment feeder 34 is manufactured from aluminum and has a teflon based coating around the outer surfaces to prevent wear.

Referring now to the hammer 36, it is basically an elongated annular device that fills the space between feeder 34 and casing 20. The hammer 36 has the center bore 92 that slideably receives the feeder 34 in a close abutting relationship to form a good metal-to-metal seal therebetween. The oil grooves 74 and the oil contained therein aid in this metal-to-metal seal. Likewise the outer edge of hammer 36 forms a good metal-to-metal seal with the inner surface of casing 20 with the hammer 36 having oil rings 94 cut in its outer surface.

From the top of the hammer 36 slanting bores 96 which have a slight taper with respect to the elongated axis of the hammer 36 and extend to undercut 98. The undercut 98 intersects the innermost lower portion of the slanting bores 96. Each of the slanting bores 96 taper inward with respect to the elongated axis by less than fifteen degrees. Location of the slanting bores 96 in the hammer 36 can be seen in FIG. 3. As many as are necessary for proper operation of the hammer may be utilized.

Figure 4:
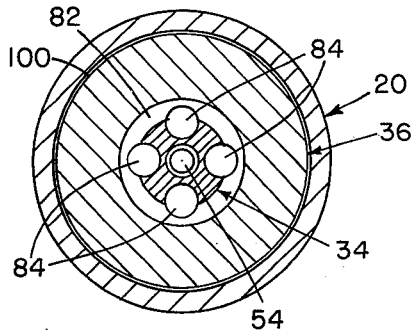
FIG. 4 is a sectional view of FIG. 1*a* taken along section lines 4—4.
Figure 5:
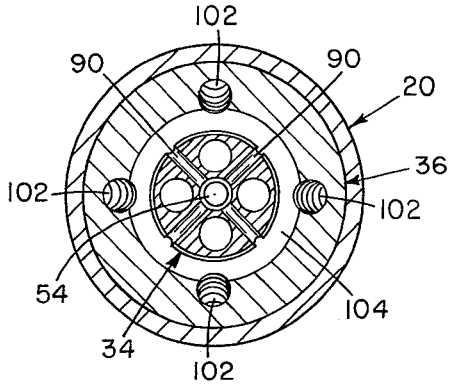
FIG. 5 is a sectional view of FIG. 1*a* taken along section lines 5—5.

The annulus forming the center portion of the hammer 36 is solid as can be seen in FIG. 4 except for a very thin elongated annulus 100 formed between casing 20 and hammer 36 by reducing the outside diameter of the hammer 36. The very thin elongated annulus 100 prevents the hammer 36 from sticking inside of casing 20 due to lateral stresses that may be applied to the pneumatic drilling tool 12.

From the bottom of the hammer 36 slanting bores 102 that are cut at a slight taper inward with respect to the elongated axis and extend to undercut 104 of the hammer 36. Again the slanting bores 102 which are at an angle of less than 15° with respect to the elongated axis can be seen in cross sectional view of FIG. 5. As many slanting bores 102 as are necessary for the proper operation of the pneumatic impact drilling tool 12 may be cut in the hammer 36.

The hammer 36, commonly called a piston, may be reversible during assembly since the upper and lower portions are identical. To prevent structural fatique in the hammer 36 caused by the continual inpacting of the hammer 36 against the anvil 28, the hammer 36 must not have any sharp edges. Therefore, each of the slanting bores 96 and 102 must be reamed to provide a circular termination thereof. Also, each of the edges on the undercuts 98 and 104 must be beveled to provide circular types edges. The upper and lower surfaces of the hammer 36 are also beveled to provide a small radii at the edges. The slanting bores 96 and 102 are chamfered to provide a rounding outer edge.

Within the anvil 28 is located a center bore 106 that has a larger upper diameter 110 defined by shoulder 108. Within the upper diameter 110 is located the exhauster 38. The exhauster 38, which provides a slideable seal inside of the center bore 92 of the hammer 36, may be formed from any suitable substance such as plastic or aluminum. A taper 112 aids in the dynamic flow of the pneumatic fluid through center bore 114 of exhauster 38. The lower portion of the exhauster 38 that fits inside of anvil 28 has an undercut 116 with a correspondingly mating undercut 118 being cut in anvil 28. The undercut 118 may have a series of inwardly extending rings 120. The space between the undercuts 116 and 118 is filled with a resilient material 122. In the preferred embodiment of the present invention the resilient material 122 is a rubber base substance that is formed on the exhauster 38. Thereafter the exhauster 38 is driven into position inside of the anvil 28 at which time the resilient material 122 expands to fill the space of both undercuts 116 and 118 thereby retaining exhauster 38 into position.

The anvil 28 has oil ring seals 124 similar to the previously mentioned oil ring seals 74 and 94. Below the striking face 126 of the anvil 28 which is hit by the striking surface 128 of the hammer 36 is located an undercut 130 which during normal operation defines an annulus between the anvil 28 and the anvil guide ring 40. The anvil guide ring 40 has a small shoulder 132 wherein it is held into position when abutted by retainer split ring 42. The retainer split ring 42, which is formed from two identical halves held into position by O-ring 134, is used to assemble the pneumatic impact drilling tool 12 and provides a lower stop for anvil 28. The outer portion of retainer split ring 42 butts against a resilient material 136 such as a rubber base substance which acts as a snap ring. The resilient material 136 retains the anvil guide ring 40 in place to prevent the hammer 36 from falling out of the casing 20 when changing anvil 28 and integral bit 30.

Figure 6:
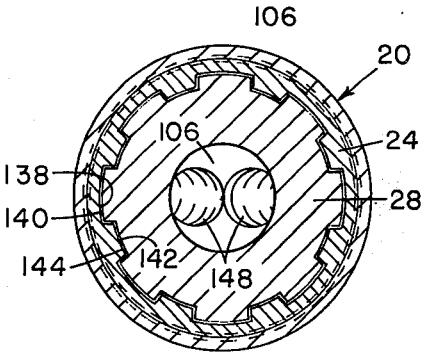
FIG.6 is a sectional view of FIG. 1*b* taken along section lines 6—6.

Below the retainer split ring 42 the lower sub 24, commonly called a driver sub, is threadably connected to casing 20 by threads 26 to hold the retainer split ring 42 and anvil guide ring 40 in position. Consequently, this holds anvil 28 inside of casing 20. Referring now to the cross sectional view shown in FIG. 6 in conjunction with FIG. 1*b*, it can be seen that anvil 28 and lower sub 24 assembled by a splined connection fit into a slotted relationship with respect to each other. The grooves 138 of lower sub 24 receive splines 140 of anvil 28 and vice-versa for grooves 142 of anvil 28 and splines 144 of lower sub 24. It should be realized that the mating grooves 138 and 142 and splines 140 and 144, respectively, between anvil 28 and lower sub 24 allow free axial movement but do not allow radial movement between the anvil 28 and the lower sub 24.

When drilling, the lower portion of the lower sub 24 butts against an outward flange 146 to force the anvil 28 and drill bit 30 downward. The center bore 106 of the anvil 28 terminates into two slanting passages 148 that communicate to the cutter bit portion 150. Within the cutter bit portion 150 are mounted hardened cutter inserts 152, normally formed from tungsten carbide. The cutter bit portion 150 has an outward flare 154 to insure that the hole being drilled is larger in diameter than the diameter of the casing 20 and drill pipe.

Though the present invention is shown in conjunction with a solid head type of bit, many other conventional drill bits may be utilized with the present invention. Even a roller cone type of bit may be utilized by a proper adjustment of the downward impact force.

METHOD OF OPERATION

Referring now to FIGS. 7–10 there is shown pictorial schematic views of the pneumatic impact drilling tool 12 to illustrate the sequential positions of the hammer 36 and air flow through the pneumatic impact drilling tool 12. Like numbers will be used to designate like parts as previously described in conjunction with FIGS. 1–6. As the pneumatic fluid (air) begins to flow through the drilling pipe large orifice 48 is subjected to a very high pressure. As a result of the high pressure the collapsible ball 44 collapses inward against the valve seat 46 thereby allowing the air to flow as indicated by the arrows in FIG. 7. The air flows around the collapsible ball 44 through the valve seat 46 and into the center bore 54 of the feeder. At the bottom of the center bore 54 of the feeder 34 a small amount of air continually flows through restrictive orifice 88. However, the majority of the air that flows through the center bore 54 flows outward through the cross slots 90, undercut 104 and slant bores 102 to the bottom of the hammer 36. The pressurized air under hammer 36 creates an upward force thereon that is proportional to the pressure times the surface area.

Figure 7:
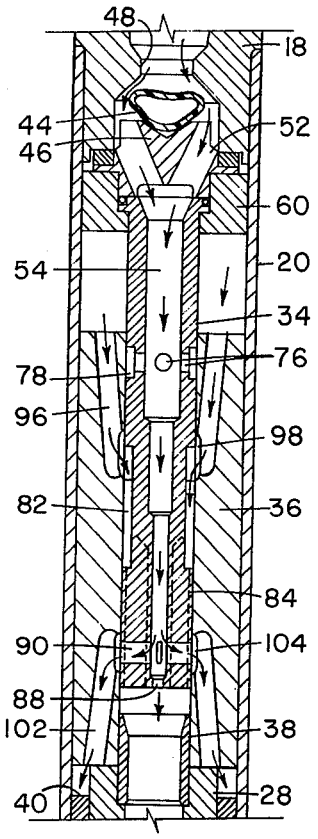
FIG. 7 is a cross sectional pictorial illustration of the air flow upon raising the hammer element.
Figure 8:
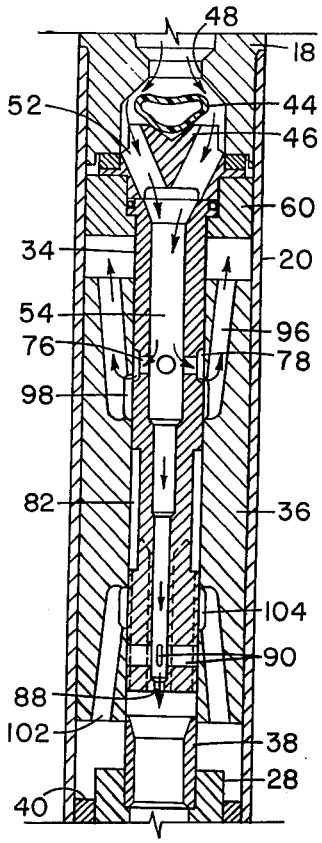
FIG. 8 is a cross sectional pictorial illustration of the air flow upon pressurization above the hammer element.

As a result of the pressure created under hammer 36, as illustrated in FIG. 7, the hammer 36 begins to move upward, which is illustrated in FIG. 8. As the hammer 36 moves upward, flow through the cross slots 90 is terminated as the undercut 104 moves past the uppermost portion of the cross slot 90. However, the air trapped below the hammer 36 between the exhauster 38 and the casing 20 continually drives the hammer 36 upward during expansion. As the hammer 36 is being driven upward by the expansion of the gases below the hammer 36 the undercut 98 moves into alignment with annulus 78 which is connected by cross bores 76 to the center bore 54 of the feeder 34. FIG. 8 shows the hammer 36 as it is being raised by the expansion gases trapped below the hammer 36 and just as the undercut 98 moves into a flow relationship with annulus 78. By the use of an undercut and an annulus a very rapid pressurization can take place by a large volume of air flow. The crescent effect that would take place by having a circular cross bore establish fluid communication with an annulus is avoided, and the resultant small initial flow is avoided. The expanding gases trapped below the hammer 36 will continually drive the hammer 36 upward until overcome by the pressurized air flowing through cross bore 76, annulus 78, undercut 98 and slant bores 96, or until the expanding gas is exhausted as will be described in the following paragraph.

Figure 9:
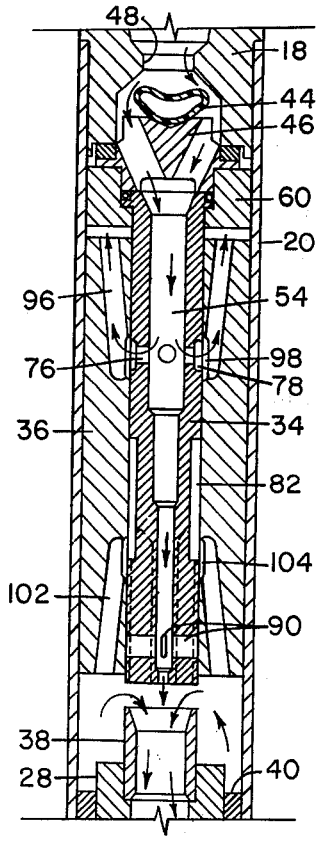
FIG. 9 is a cross sectional pictorial illustration of the air flow upon maximum pressurization above the hammer element and exhausting below the hammer element.

Referring now to FIG. 9 of the drawings, hammer 36 has reached its uppermost position. The pressure above hammer 36 has overcome the upward motion caused by the pressurized gas initially injected below hammer 36 which is now being discharged because hammer 36 is no longer in a slideable mating relationship with the exhauster 38. Because there is a high source of pressurized air above hammer 36, and all the pressurized air has now been exhausted from below hammer 36, a very large downward force will be exerted on the hammer 36. This downward force will drive the hammer 36 downward with a tremendous force.

Figure 10:
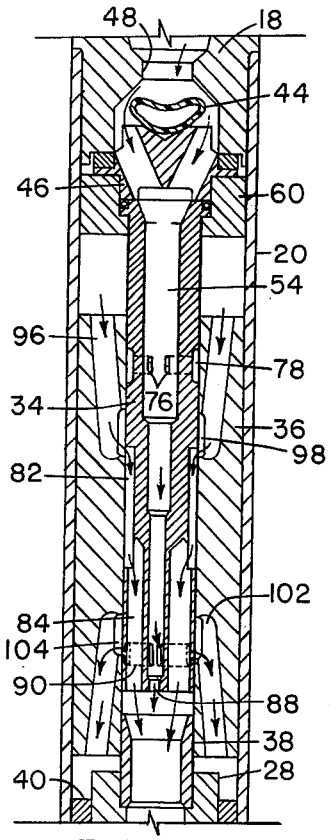
FIG. 10 is a cross sectional pictorial illustration of the air flow immediately prior to impact of the hammer element.

FIG. 10 shows the hammer 36 moving downward at a very rapid rate and in a position immediately prior to impact. The pressurized air above hammer 36 starts evacuation immediately prior to impact when undercut 98 moves into fluid communication with elongated annulus 82 by discharging out the exhauster 38 via axial bores 84. In FIG. 10 the feeder 34 has been rotated forty-five degrees to better illustrate the axial bores 84. By having a sliding mating relationship between undercut 98 and elongated annulus 82 a very rapid discharge of the pressurized air above hammer 36 can be accomplished. Also immediately prior to impact of the hammer 36 (as can be seen in FIG. 10) pressurized air begins building up below the hammer 36 by the establishing of a slideable mating relationship between cross slots 90 and undercut 104. The pressurization below the hammer 36 repeats the cycle as described in conjunction with FIGS. 7–10. FIG. 7 also illustrates the exhausting above hammer 36.

The downward force of the hammer 36 is determined by the pressure that is developed in the annulus above hammer 36 times the area of the upper surface of the hammer 36 times the stroke length of the hammer. The pressure below the hammer 36 has been reduced to essentially zero by the time the hammer 36 reaches its uppermost position. Because the pressurization below hammer 36 begins a split second prior to impact, the amount of pressurization that has occurred below hammer 36 at the time of impact is negligible. Rapid pressurization thereafter immediately raises the hammer 36 back to the raised position. The downward impact of the hammer 36 is delivered through the anvil 28 to the drill bit 30.

By using a pneumatic impact tool less of a hold down force is necessary in rotary drilling and wear on the drill bits can be reduced. Also, a pneumatic impact drilling tool such as shown in the present invention can increase the drilling rate of a rotary drilling operation by a substantial amount.

The present pneumatic impact drilling tool 12 gives a maximum downward force with a maximum repetition rate for a given diameter operation. By the use of the center feed as described in the present invention, a larger surface area against which the pressurized air can act to drive the hammer downward is provided. There is less of a loss of effective area by using a center feed through the hammer than by feeding through the casing as was done in many of the prior drilling devices, not to mention a substantial weakening of the casing itself. It becomes very important to rapidly pressurize and depressurize the area above the hammer to insure the maximum repetition rate. This is accomplished in the present invention by a slideable mating relationship between an undercut 98 and an annulus 82 that will allow a very large volume of flow upon initially establishing fluid communication. The same is true for the exhausting of the pressurized air above the hammer 36. In the present invention a maximum exhaust capability is established by means of the elongated annulus 82 and the axial bores 84 that receives the pressurized air via slanting bores 96 and undercut 98. Even with the very rapid pressurization and depressurization above hammer 36, the area below hammer 36 also maintains a good pressurization and depressurization rate. The undercut 104 allows maximum flow of pressurized air through cross slots 90 to raise the hammer 36 and exhauster 38 will almost instantaneously evacuate any remaining pressurized air below hammer 36.

The restrictive orifice 88 acts as a venturi to create a vacuum that aids in exhausting both above and below hammer 36. When water is injected with the air, the water tends to flow through the restrictive orifice 88 which also aids the venturi effect due to the increased weight of water over air. The venturi effect decreases the exhaust time thereby increasing rate of repetition of the hammer 36. (See FIGS. 9 and 10).

Many times it may be desirable to lift the drill bit 30 off the bottom of the hole being drilled. If the impacting of the hammer 36 is not stopped, the impact drilling tool 12 and other equipment may be damaged. Upon picking the drill bit 30 off bottom, the anvil 28 will drop down until shoulder 131 comes to rest against retainer split ring 42. The hammer 36 will follow anvil 28 thereby uncovering annulus 78 and cross bores 76. Cross slots 90 will be covered to prevent pressure from developing below hammer 36. Now the pressurized air may blow through center bore 54, cross bores 76, annulus 78, slanting bores 96, undercut 98, elongated annulus 82, axial bores 84 and out exhauster 38. This allows the tool 12 to blow through slanting passages 148 to the drill bit 30. While drilling through loose formations, a freely blowing device is the preferred method of drilling to give the maximum capacity to raise the cutting to the surface.

Figure 11:
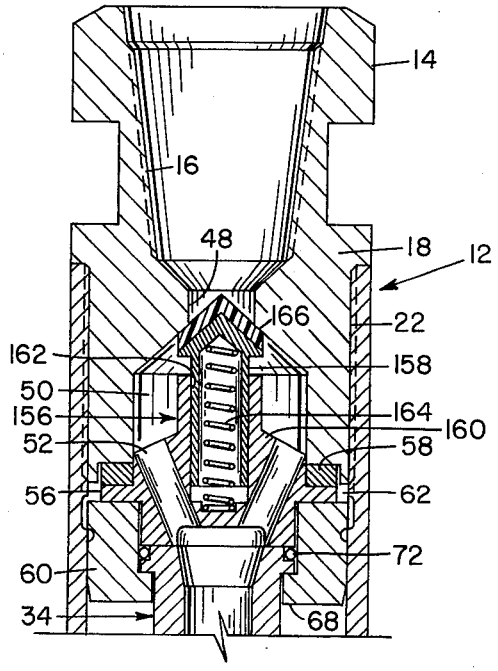
FIG. 11 is an elevated cross sectional view of a portion of FIG. 1*a* illustrating a different type of check valve.

Referring now to FIG. 11 of the drawings, there is shown an alternative check valve from the check valve 32 previously described in conjunction with FIG. 1a. In FIG. 11 like numbers will be used to designate like parts with the new portions being described immediately hereafter. The check valve 156 has a check valve stem 158 and a valve seat 160. The valve seat 160 has a bore 162 cut therein for slideably receiving stem 158. Carried inside of stem 158 is a spring 164 that continually pushes the stem 158 upward from the valve seat 160. The uppermost portion of the stem 158 has a resilient material 166 to close large orifice 48 thereby preventing a backflow of air in the pneumatic impact drilling tool 12. With a very small pressure the check valve stem 158 will be pushed downward into the valve seat 160 thereby allowing flow through slanting passages 52. If it becomes desirable during a drilling operation to replace check valve 32 with another type of check valve, check valve 156 may be substituted in its entirety without the change of any additional parts.

I claim:

1. An impact drilling tool for connection in a string of drilling pipe, said tool comprising:

an upper sub for connection to said drilling pipe; a casing with an upper end connected to said upper sub;

anvil means slideably received in a lower end of said casing, said anvil means being connected to bit means;

hammer means carried in said casing above said anvil means, said hammer means reciprocating along the elongated axis of said tool for striking said anvil means during each cycle;

means for feeding pressurized pneumatic fluid from said drilling pipe through the center portion of said hammer means, said feeder means being retained by said upper sub and extending downwardly therefrom for providing slideable valve type passages that open and close on each cycle for pressurization below said hammer means, for pressurization above said hammer means, and for exhaust above said hammer means; and exhaust means carried by said anvil means and located between said hammer means and said anvil means for exhausting during each cycle the pressurization below said hammer means through a space separating said feeder means and said exhaust means and subsequently exhausting through said exhaust means to said bit means, said feeder means terminating above said exhaust means to form said separating space.

2. The impact drilling tool as recited in claim 1 wherein said feeder means includes as part of said slideable valve type passages a first annulus in fluid communication with first bore means in said feeder means, said first annulus slideably mating a first undercut in said hammer means that communicates above said hammer means, said first annulus and first undercut providing rapid pressurization above said hammer means during each cycle.

3. The impact drilling tool as recited in claim 2 wherein said feeder means further includes as part of said slideable valve type passages a second annulus in fluid communication through second bore means of said feeder means with said bit means, said second annulus and said first undercut slideably mating to provide rapid depressurization above said hammer means during each cycle.

4. The impact drilling tool as recited in claim 3 wherein said feeder means further includes as part of said slideable valve type passages cross bores connected to said first bore means, said cross bores slideably mating a second undercut in said hammer means that communicates below said hammer means, said cross bores and said undercut providing rapid pressurization below said hammer means during each cycle.

5. The impact drilling tool as recited in claim 4 wherein said exhaust means extends upward from said anvil means, said exhaust means having a center passage for rapidly exhausting any pressurization below said hammer means to said bit means upon said hammer means moving above the top of said exhaust means.

6. The impact drilling tool as recited in claim 1 wherein said hammer means includes upwardly slanting passages connecting to a first undercut for said pressurization above said hammer means and for said exhaust above said hammer means.

7. The impact drilling tool as recited in claim 6 wherein said hammer means further includes downwardly slanting passages and a second undercut for said pressurization below said hammer means.

8. The impact drilling tool as recited in claim 7 wherein said hammer means has curved edges, and said upwardly slanting passages, downwardly slanting passages, first undercut and second undercut have curved terminations thereof to prevent structural fatigue during operation of said tool.

9. The impact drilling tool as recited in claim 1 further including a check valve between said feeder means and said upper sub, said check valve allowing small radial adjustment of said feeder means, said check valve having a means for sealing the outer edges of said feeder means.

10. A gas powered impact tool which comprises: a housing adapted to be connected to a source of pressurized gas;

an anvil located in the lower end of said housing and having an exhaust port formed therein;

feeder means mounted in said housing above said anvil and having formed therein a high pressure flow passage and an exhaust flow passage, said high pressure flow passage being in fluid communication with said source of pressurized gas; and a hammer mounted in said housing and defining therewith a central opening extending therethrough, an upper flow passage extending internally from a top surface of said hammer to said central opening, a lower flow passage extending internally from a bottom surface of said hammer to said central opening;

said hammer being telescopically movable on said feeder means between a first position wherein said high pressure flow passage of said feeder means is in fluid communication with said lower flow passage and said exhaust flow passage is in fluid communication with said upper flow passage, and a second position wherein said high pressure flow passage of said feeder means is in fluid communication with said upper flow passage and said lower flow passage of said hammer is in fluid communication with said exhaust port of said anvil;

entrance of said exhaust flow passage of said feeder means being located approximately between said upper flow passage and said lower flow passage of said hammer means.

11. The gas powered impact tool as defined in claim 10 wherein said feeder means has a central bore formed therein for said high pressure flow passage, and said central bore having first and second lateral ports extending through said feeder means, a first undercut extending around said feeder means in fluid communication with said first lateral ports, said central opening in said hammer including second undercut therein in fluid communication with said upper flow passages.

12. The gas powered impact tool as defined in claim 11 wherein said feeder means includes a third undercut in communication with said exhaust flow passage, said exhaust flow passage being in communication with said exhaust port.

13. The gas powered impact tool as defined in claim 12 wherein said central opening in said hammer includes a fourth undercut in fluid communication with said lower flow passages.

14. The gas powered impact tool as defined in claim 13 further including a check valve above said feeder means to permit flow of said pressurized gas to said feeder means, and sealing means between said check valve and said feeder means for preventing premature pressurization above said hammer means.

* * * * *

UNITED STATES PATENT AND TRADEMARK OFFICE

CERTIFICATE OF CORRECTION

PATENT NO. : 3,964,551

DATED : June 22, 1976

INVENTOR(S) : Grey Bassinger

It is certified that error appears in the above-identified patent and that said Letters Patent are hereby corrected as shown below:

Column 4, line 62, delete "74" and insert --72--.

Column 5, line 38, delete "interact" and insert --intersect--.

Column 5, line 38, delete "34" and insert --84--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*